US011653795B2

(12) United States Patent
Valdez et al.

(10) Patent No.: US 11,653,795 B2
(45) Date of Patent: May 23, 2023

(54) SUPPORTIVE DEVICE FOR SHELVES, SEATS AND STEPS IN WET CONSTRUCTION AREAS

(71) Applicant: Reyes Designs LLC, Oklahoma City, OK (US)

(72) Inventors: Ivan Reyes Valdez, Oklahoma City, OK (US); Alan Reyes Valdez, Oklahoma City, OK (US)

(73) Assignee: Reyes Designs LLC, Oklahoma City, OK (US)

( * ) Notice: Subject to any disclaimer, the term of this patent is extended or adjusted under 35 U.S.C. 154(b) by 375 days.

(21) Appl. No.: 17/033,846

(22) Filed: Sep. 27, 2020

(65) Prior Publication Data

US 2021/0121023 A1 Apr. 29, 2021

Related U.S. Application Data

(60) Provisional application No. 62/926,531, filed on Oct. 27, 2019.

(51) Int. Cl.
*A47K 3/00* (2006.01)
*A47K 3/28* (2006.01)
(Continued)

(52) U.S. Cl.
CPC ..... *A47K 3/004* (2013.01); *A47B 96/021* (2013.01); *A47B 96/022* (2013.01); *A47C 1/00* (2013.01);
(Continued)

(58) Field of Classification Search
CPC ..... A47K 3/004; A47K 3/122; A47K 3/282; A47K 2201/02; A47K 2201/00;
(Continued)

(56) References Cited

U.S. PATENT DOCUMENTS 3,640,041 A 2/1972 Michieli
3,919,950 A * 11/1975 Frazelle ..... A47B 87/00 108/108
(Continued)

FOREIGN PATENT DOCUMENTS

DE 1936096 A1 * 6/1970 ..... A47B 96/021
DE 202016003734 U1 * 9/2016 ..... A47K 2201/00
(Continued)

OTHER PUBLICATIONS

Flooring Supply Shop; "Better Bench Triangular Shelf 17", retrieved on Sep. 27, 2020 from https://www.flooringsupplyshop.com.
(Continued)

*Primary Examiner* — Michael Safavi
(74) *Attorney, Agent, or Firm* — Robert H. Frantz

(57) ABSTRACT

A structurally supportive device for constructing a weight-bearing feature in a wet area of a building, such as but not limited to a shelf, seat or step in a shower, bath, tub, sauna, spa or swimming pool, comprising a triangular horizontal support surface with first, second, and third edges, wherein the first and the second edges form a right angle; a vertical presentation surface depending down from the third edge; a horizontal support lip along a bottom edge of the vertical presentation surface; and attachment tabs protruding from the first and second edges, with each tab running at least two-thirds the length of the first or second edge; wherein the tabs protrude sufficiently far to be received into a slot formed into a wall surface finishing material but not so far as to penetrate a waterproof membrane or a wall board, and wherein the horizontal support surface and vertical presentation surface are configured to receive a feature finishing material such as tile, stone or solid surface material.

20 Claims, 5 Drawing Sheets

(51) Int. Cl.

| | |
|---|---|
| ***A47B 96/02*** | (2006.01) |
| ***E04H 4/14*** | (2006.01) |
| ***A47K 3/12*** | (2006.01) |
| ***A47C 1/00*** | (2006.01) |

(52) U.S. Cl.
CPC ..... *A47K 3/122* (2013.01); *A47K 3/282* (2013.01); *E04H 4/144* (2013.01)

(58) Field of Classification Search
CPC ... A47B 96/021; A47B 96/022; A47B 96/027; A47B 96/02; A47C 1/00
See application file for complete search history.

(56) References Cited

U.S. PATENT DOCUMENTS

| | | | | |
|---|---|---|---|---|
| 4,708,310 | A | 11/1987 | Smith | |
| 5,340,070 | A | 8/1994 | Soma | |
| 5,542,218 | A | 8/1996 | Romepl | |
| 5,732,421 | A | 3/1998 | Scherberger | |
| 6,052,845 | A | 4/2000 | Harvey | |
| 6,196,139 | B1 * | 3/2001 | Jensen | A47B 96/027 108/42 |
| 6,289,529 | B1 | 9/2001 | Harvey | |
| 6,301,725 | B1 | 10/2001 | Harvey | |
| 7,987,535 | B1 * | 8/2011 | Tesch | A47K 3/286 297/14 |
| 8,225,435 | B2 | 7/2012 | Kik, Jr. et al. | |
| 8,857,109 | B1 * | 10/2014 | Kirby | A47K 3/282 4/578.1 |
| 9,277,818 | B1 * | 3/2016 | Preston | A47B 96/066 |
| 9,402,476 | B2 | 8/2016 | Crandall | |
| 2002/0017499 | A1 * | 2/2002 | Bengoechea | A47B 96/022 211/90.01 |
| 2005/0235410 | A1 | 10/2005 | Rizvi | |
| 2009/0077903 | A1 | 3/2009 | Madesh | |
| 2011/0167746 | A1 * | 7/2011 | Scalise | A47K 3/281 52/391 |
| 2016/0095437 | A1 * | 4/2016 | Crandall | A47B 96/024 211/90.01 |
| 2016/0192777 | A1 * | 7/2016 | Karins, Sr. | A47B 96/06 211/119.009 |
| 2017/0130895 | A1 * | 5/2017 | Sisto | A47B 96/022 |
| 2021/0022501 | A1 * | 1/2021 | Cluff | A47B 96/063 |

FOREIGN PATENT DOCUMENTS

| | | | | |
|---|---|---|---|---|
| DE | 202016100192 | U1 * | 6/2017 | |
| DE | 202017002746 | U1 * | 8/2017 | A47B 96/022 |
| DE | 102016115677 | B4 * | 11/2018 | A47K 1/08 |
| DE | 202019103950 | U1 * | 8/2019 | A47B 96/022 |
| DE | 202018102357 | U1 * | 9/2019 | A47K 3/281 |
| DE | 202019005109 | U1 * | 2/2020 | E04H 4/144 |
| EP | 2260744 | A1 * | 12/2010 | A47B 96/022 |
| FR | 2608398 | A1 * | 6/1988 | A47B 96/022 |
| WO | WO-9302594 | A1 * | 2/1993 | A47B 96/02 |
| WO | WO-2011088166 | A1 * | 7/2011 | A47B 96/027 |
| WO | 2016100426 | A1 | 6/2016 | |
| WO | WO-2016100426 | A1 * | 6/2016 | A47B 96/02 |
| WO | WO-2016135431 | A1 * | 9/2016 | E04B 2/86 |

OTHER PUBLICATIONS

Flooring Supply Shop; "Goof Proof Shower Seat Ready to Tile", retrieved on Sep. 27, 2020 from https://www.flooringsupplyshop.com.

Flooring Supply Shop; "RetroShelf Tile Ready Retro Shelf", retrieved on Sep. 27, 2020 from https://www.flooringsupplyshop.com.

Mark E. Industries; "Goof Proof Corner Shelf"; retrieved on Sep. 27, 2020 from http://www.kirb-perfect.com/corner-shelf.html.

* cited by examiner

SUPPORTIVE DEVICE FOR SHELVES, SEATS AND STEPS IN WET CONSTRUCTION AREAS

INCORPORATION BY REFERENCE

U.S. Provisional Patent Application 62/926,531, filed on Oct. 27, 2019, by Ivan Reyes Valdez, is hereby incorporated by reference in its entirety including drawings.

FIELD OF THE INVENTION

This non-provisional patent application claims benefit of the filing date of U.S. Provisional Patent Application 62/926,531, filed on Oct. 27, 2019, by Ivan Reyes Valdez. The present invention relates to certain improvements to construction components for forming seats, shelves and steps in wet locations such as, but not limited to, showers, tubs, saunas, spas and swimming pools.

BACKGROUND OF INVENTION

Walls of most wet locations in buildings such as homes, apartments, hospitals, gyms, and clubs are provided with an exterior of tile, manmade solid surface material, natural stone, cultured stone which is easy to clean, attractive, and durable. These areas include, but are not limited to, showers, tubs, saunas, spas and swimming pools. Constructing horizontal utility surfaces such as shelves, steps and seats presents an especially difficult problem, during new construction and during remodel or retrofit. While the preferred exterior material such as stone or tile provides a durable cleanable surface, most of these materials are not suitable for bearing significant amounts of weight. Further, most of these materials are heavy, presenting an more difficult mounting problem to tiled or stone-covered vertical surfaces such as walls.

SUMMARY OF THE EXEMPLARY EMBODIMENTS OF THE INVENTION

Disclosed is a structurally supportive device for constructing a weight-bearing feature in a wet area of a building, such as but not limited to a shelf, seat or step in a shower, bath, tub, sauna, spa or swimming pool, comprising a triangular horizontal support surface with first, second, and third edges, wherein the first and the second edges form a right angle; a vertical presentation surface depending down from the third edge; a horizontal support lip along a bottom edge of the vertical presentation surface; and attachment tabs protruding from the first and second edges, with each tab running at least two-thirds the length of the first or second edge; wherein the tabs protrude sufficiently far to be received into a slot formed into a wall surface finishing material but not so far as to penetrate a waterproof membrane or a wall board, and wherein the horizontal support surface and vertical presentation surface are configured to receive a feature finishing material such as tile, stone or solid surface material.

BRIEF DESCRIPTION OF THE DRAWINGS

The figures presented herein, when considered in light of this description, form a complete disclosure of one or more embodiments of the invention, wherein like reference numbers in the figures represent similar or same elements or steps.

DETAILED DESCRIPTION OF ONE OR MORE EXEMPLARY EMBODIMENT(S) OF THE INVENTION

Figure 1:
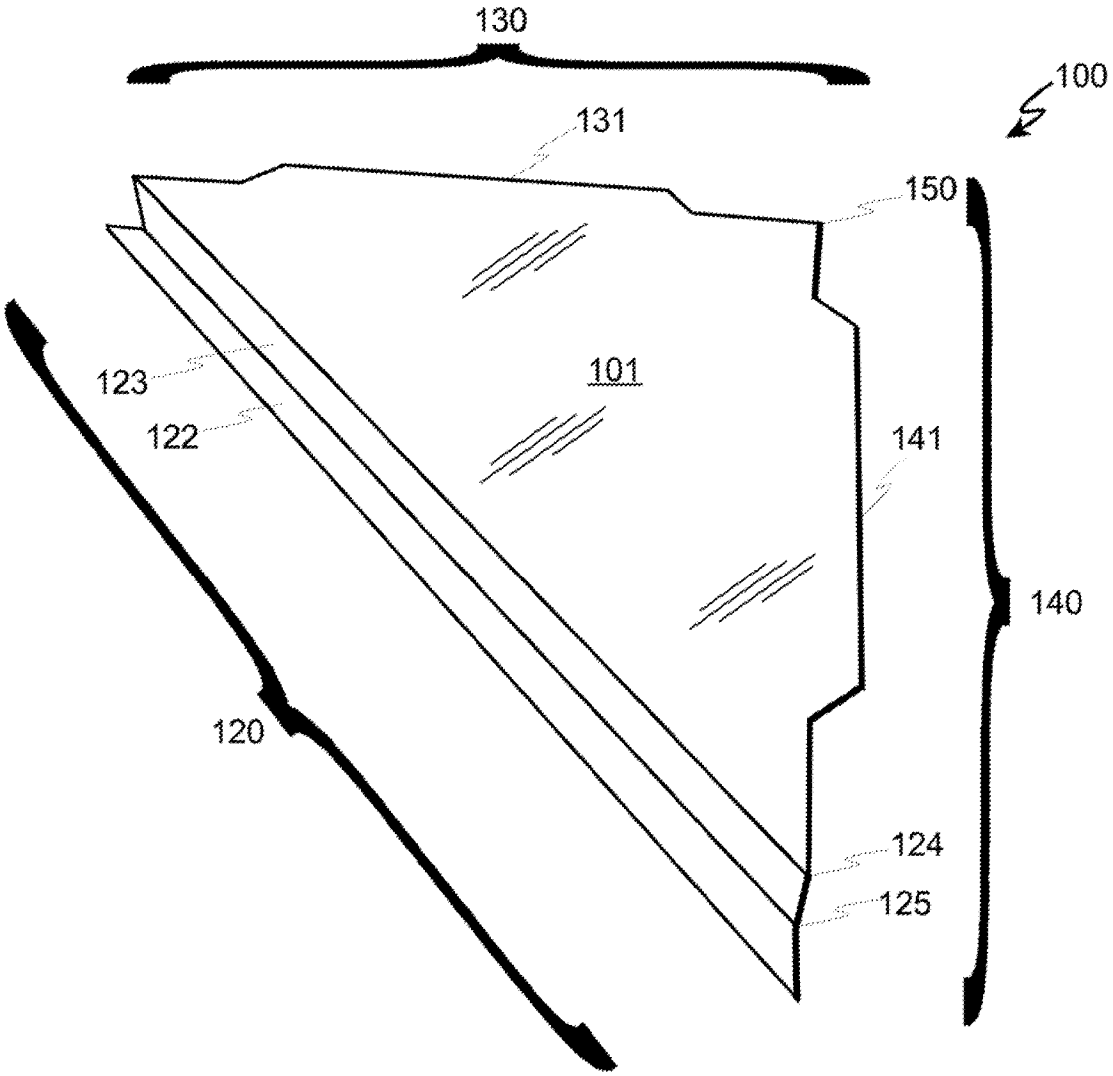
FIG. 1 depicts an isometric view of an example embodiment according to the present invention.

The present inventor(s) have recognized an unaddressed need in the construction arts for a device to support tiled, stone-covered or manmade solid surface-covered shelves, steps and seats in wet locations of buildings such as, but not limited to, showers, tubs, baths, saunas, spas and swimming pools.

There is a plurality of products currently on the market for either new construction application, retrofit, remodel, or all applications. Some do not readily accept application of tile, cultured stone, natural stone or manmade solid surface materials (e.g., Corian™, Avonite™, Gibraltar™, Staron™, etc., and instead present their own metallic, ceramic, or porcelain surfaces. This can be problematic because the provided surface appearance may not fit well with the finishes in the rest of the room. Many applications and customers wish for the shelf, step, or seat to have the same tile, stone or solid surface material as the rest of the surrounds in the tub, bath, shower, sauna, or swimming pool.

Some of the available products are overly intricate or complicated in their mechanical design, rendering them too expensive, and/or too heavy for cost efficient shipping. While some of the available products also depend on bolts and screws which penetrate not only the attractive waterproof exterior product (tile, stone, etc.), but also penetrate the waterproof membrane behind the exterior product and can lead to costly leaks.

Still other available products rely on adhesives to attach the supportive device to the surface of the waterproof exterior product (tile, stone, etc.), which may fail under weight often because such surfaces are designed specifically to be highly resistant to anything sticking to them. This presents a difficult problem selecting an effective adhesive for the weight-bearing attachment of the supportive device.

These shortcomings and other objectives are met by the supportive device for shelves, seats and steps in wet areas of building construction. Embodiments of the present invention enable a craftsman to install and finish with tile, stone or other solid material, a shelf, seat or steps in a wet location such as, but not limited to, a shower, a tub, a bath, a sauna, a spa or a swimming pool, in minutes instead of hours. Embodiments according to the present invention cut down on materials needed when adding a additional permanent corner shelf, for example, whether during new construction, retrofit or remodel. Embodiments are non-intrusive with respect to the waterproof membrane to prevent leaks, thereby eliminating a need for supplemental waterproofing of the wall substrate. These embodiments present a top surface and a front surface suitable for receiving tiles or sheets of cultured stone, natural stone or manmade solid surface material to match or accent the surround walls and fixtures. With an embodiment of the present invention, the craftsman can cover the top and front sides with the same tile or material as the existing wall, making a more aesthetically pleasing final product.

Embodiments according to the present invention also allow for small format tiles to be used on a corner shelf, such as 1 inch by 1 inch by ¼ inch thick tiles. The $1/16^{th}$ inch thickness of at least one embodiment of the present invention allows for easy installation in thin cut lines in grout lines or tiles. This enables easy and quick addition of a shelf, seat or step to an existing wet location using a typical angle grinder blade of ⅛" thickness to cut the slot into the grout line or into the tiles to insert tabs of the supportive device.

As such, the simple design and use of embodiments of the present invention will allow for any person in the construction, remodel, and home improvement industry to make these improvements to wet areas of buildings. Further, due to the present invention's minimized fabrication complexity, it is low cost to produce and lightweight for cost efficient shipping. And, by providing an installation mechanism and method which does not require perforation of the waterproof membrane in the wall, thereby avoiding supplemental waterproofing materials and labor, the work load installing such a shelf, seat or step in new construction or pre-existing wet areas is reduced.

In one embodiment according to the present invention, illustrated in FIG. 1, particularly well suited for a corner shelf, the supportive device 100 is essentially triangular in shape and fabricated from a sheet of $1/16^{th}$ inch thick material such as 5052 aluminum, plastic, or resin. Two 130 and 140 of the three edges of the triangular device form an essentially right angle 150 to each other, and each of these two edges is provided with a tab 131 and 141 which protrudes from the edge for being received into a slot formed in the walls of the wet area. The third edge 120, which is the front presentation edge, is provided with a vertical portion 123 and a small horizontal lip 122.

In general, to install various embodiments of the present invention, the craftsman cuts to slots on opposing walls of the wet area (shower, tub surrounds, etc.) corresponding to the tabs on the device. The slots can be cut into the existing grout lines or into the wall tiles. Then, mortar, thin-set adhesive (e.g. FlexBond™) or other suitable waterproof adhesive is used to secure the tabs into the slots. Finally, tile, cultured stone, natural stone or other solid surface materials 301 are applied to the top surface and the front presentation surface of supportive device 100, wherein the small horizontal lip provides support for the weight of the finishing product.

Figure 2:
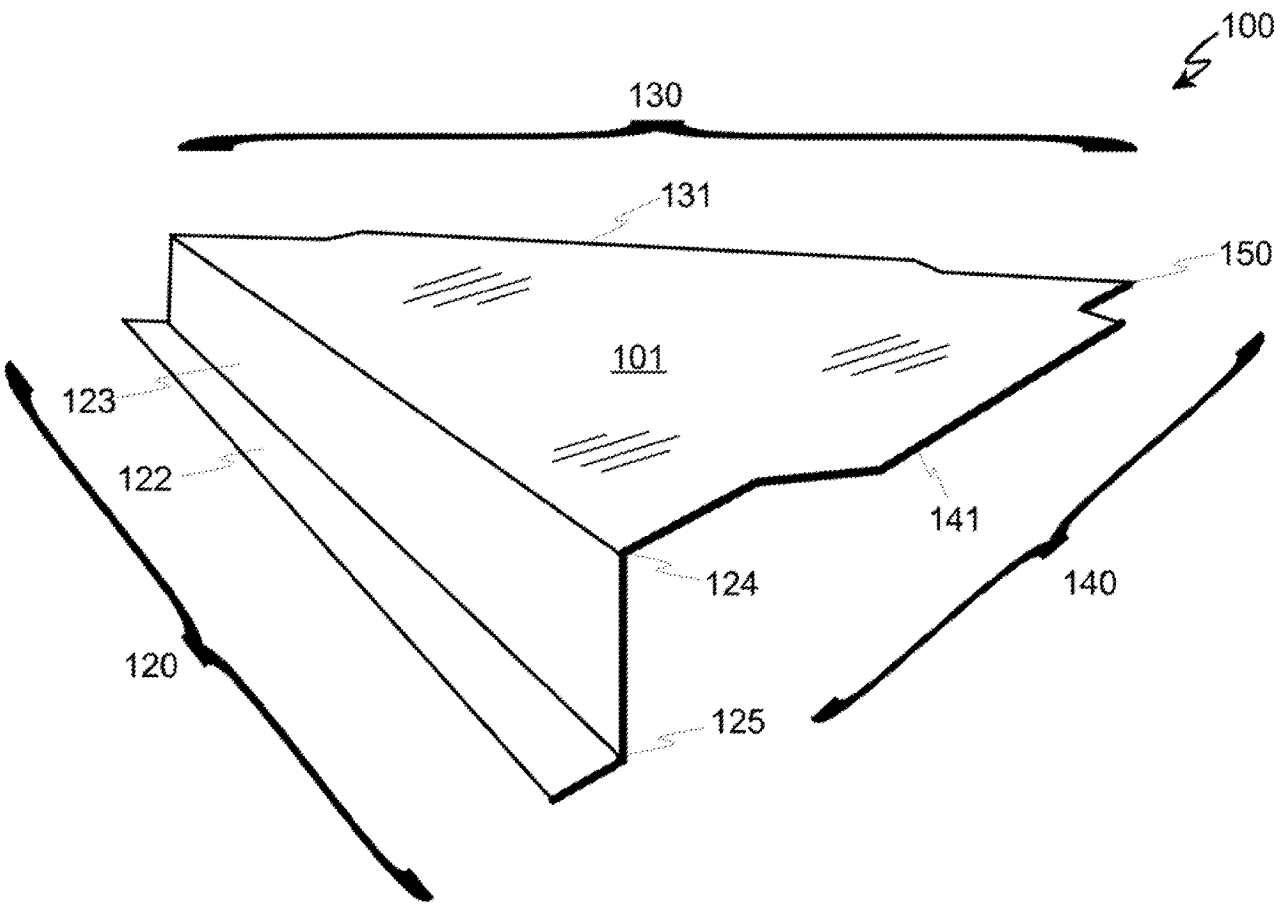
FIG. 2 depicts a side view of an example embodiment according to the present invention.

Referring now to FIG. 2, the relationships between the main portion 101, which is bounded by the three edges 120, 130 and 140, the vertical presentation portion 123, and the horizontal support lip 122 are shown. The essentially right angles 124 and 125 may be created by bending, stamping, crimping, molding, soldering, welding, glueing, machining or other known methods suitable for the material being used to fabricate the device 100. In one example embodiment, 1/16th inch thick 5052 aluminum sheet material is shaped by cutting, machining, stamping, etc., then folded and finished appropriately, to provide a front (presentation) edge of about 16 inches. For such an embodiment with a 45 degree corner shelf, each side would be approximately 11.3 inches. Also according to this example embodiment, each tab 131 or 141 is provided in a single unitary protrusion from its respective edge 130 or 140 approximately $2/3^{rd}$ or more of the total length of the respective edge. By providing a single, long tab, the horizontal sheet material 101 is provided with nearly full-length support from sagging or bending by the bottom edge of the slot formed in the wall material (e.g., tile, cultured stone, natural stone, etc.). If two or more shorter tabs are used, such as one toward the front of the edge and one towards the corner 150 of the device, a section of the center area of the sheet material 101 between the tabs would be relatively unsupported by the slot in the wall and could flex upon bearing weight. At minimum, this flexing could lead to cracking of the grout, tiles or stone on top of the device, and worse, could lead to failure of the device to support weight. For this reason, the preferred embodiment according to the present invention provides for a single, longer tab on each installation edge 130 and 140.

Figure 3:
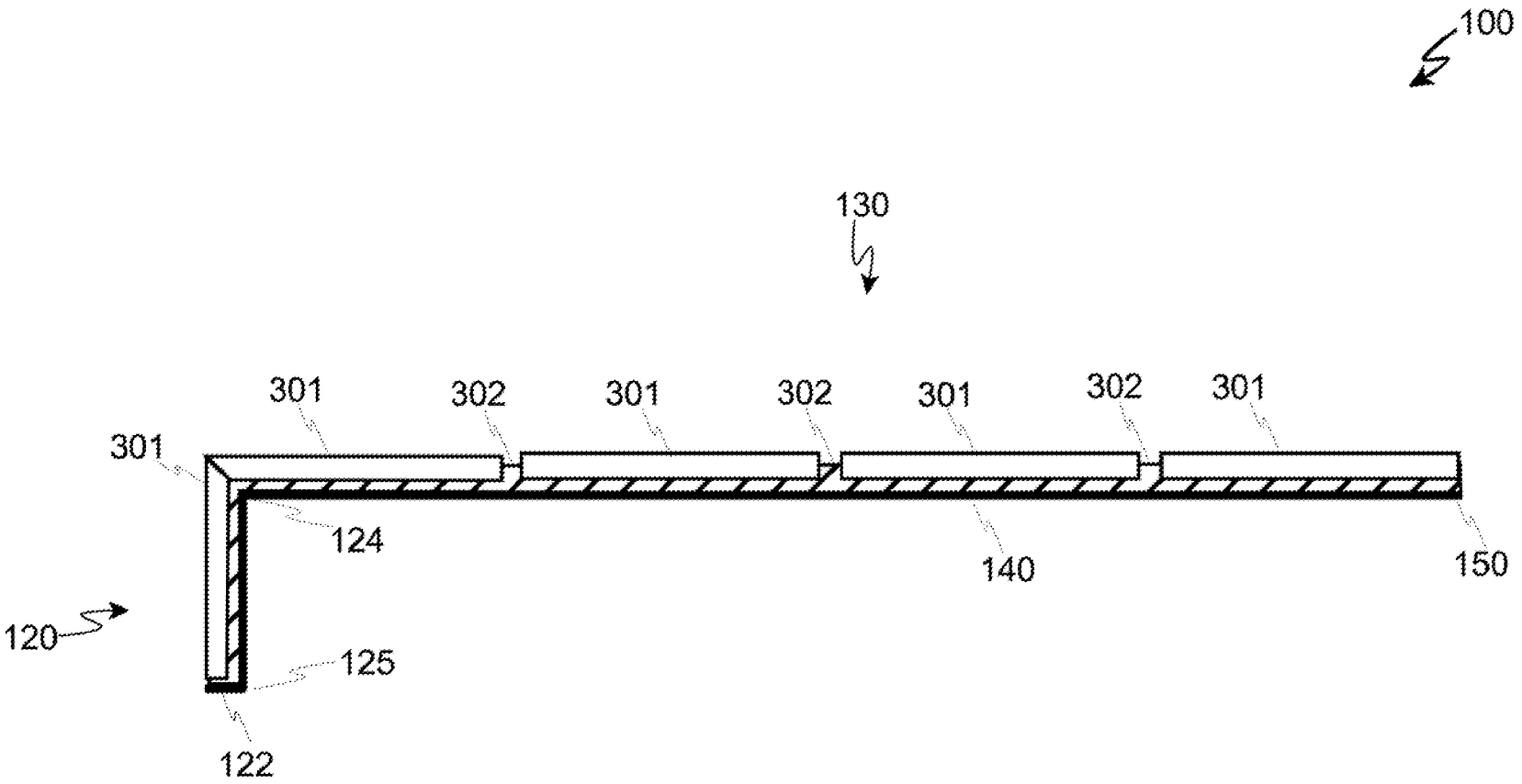
FIG. 3 illustrates of an example embodiment according to the present invention after application of a feature finishing material such as tile, stone or solid surface material.

FIG. 3 shows a support device 100 from an edge view with tiles 301 applied to the top surface 130 using a thin-set product 302. The presentation edge tiles 301 are generally installed with their surface flush with the front edge of the horizontal support lip 122.

Figure 4:
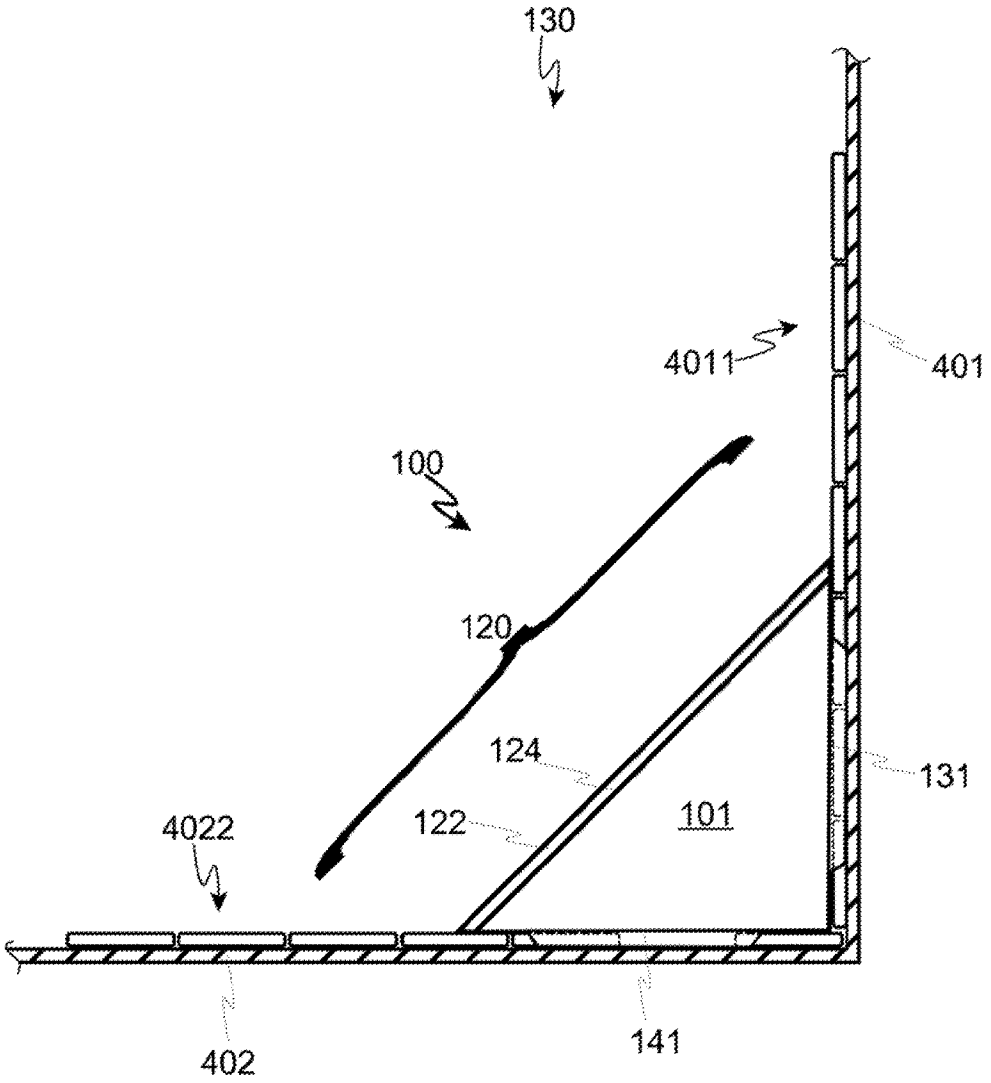
FIG. 4 shows a top-down view of an installation of of an example embodiment according to the present invention.

Referring now to FIG. 4, a top-down view of an installed device according to at least one embodiment is shown. The perpendicular walls 401 and 402 for a corner of a wet area such as a bath, shower, tub, sauna, spa or pool, and in this example, field tiles 4011 and 4022 are applied to the walls 401 and 402, respectively, often with a waterproof membrane between the walls and the field tiles. To install the supportive device 100, two slots are cut into the grout lines or into the field tiles at appropriate locations on the walls 401 and 402 to receive the tabs 131 and 141, wherein the tabs are affixed using an adhesive, thin-set adhesive or mortar. Now, the upper surface 101 may be provided with tiles 301 or sheets of stone or solid surface material, as well as to the vertical presentation surface 123 to provide a finished, waterproof and barrier non-penetrating solution.

Dimensions of the specific embodiment may vary depending on the application and function of the finished installation. For example, smaller dimensions for a shelf may be employed, which larger dimensions may be employed for a seat. A set of several units of varying dimensions, such as a set of sequentially smaller and smaller units, may be employed to create a set of steps for a step-down tup, spa or pool. The width of the supportive lip may also be varied depending on the intended surface material to be bonded or affixed to the device, such as ¼" for standard bath tiles, or thicker for sheets of cultured or natural stone. Similarly, the tabs protruding from the installation edges of various embodiments may be various dimensions to match the wall finish material (e.g., tiles, stone, etc.) into which the slots are formed, but not to exceed the thickness of the wall finish material so as to avoid penetrating the waterproof membrane or the walls themselves.

Figure 5:
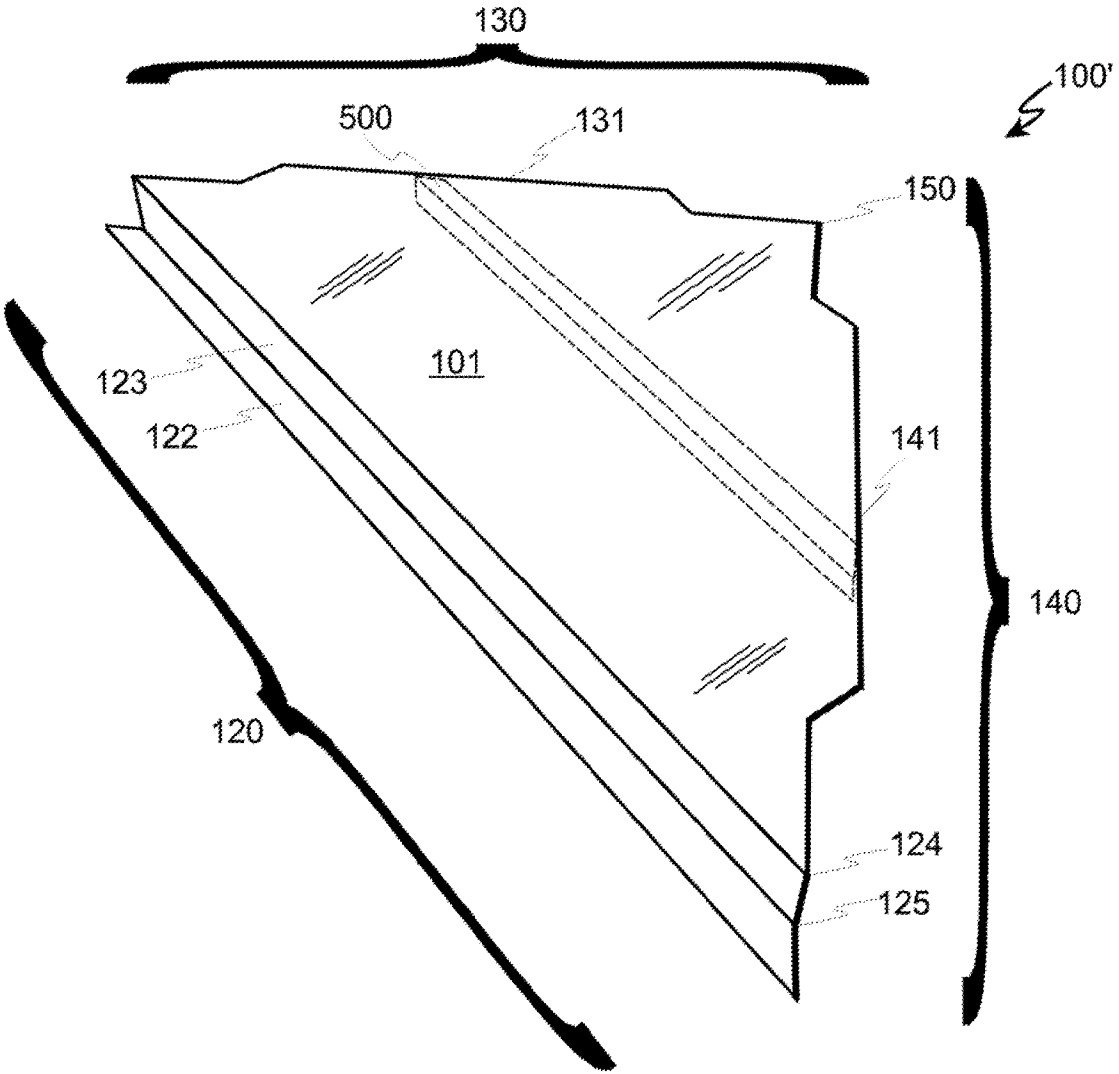
FIG. 5 illustrates of an example embodiment according to the present invention having a supplemental support member.

In some embodiments, such as the one 100' shown in FIG. 5, a cross member 500 may be provided beneath the support surface 101 to strengthen it and reduce flexing under weight. This is especially useful for larger embodiments, such as bottom steps and seats.

In some embodiments according to the present invention, the sheet material may be provided a texture, such as through stamping, embossing, debossing, or a plurality of holes to increase adhesion to the device by the feature finishing materials (e.g., tile, stone, etc.).

Conclusion. The terminology used herein is for the purpose of describing particular exemplary embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof, unless specifically stated otherwise.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The foregoing example embodiments do not define the extent or scope of the present invention, but instead are provided as illustrations of how to make and use at least one embodiment of the invention.

We claim:

1. A structurally supportive device for constructing a weight-bearing horizontal feature in a wet area of a building comprising:

an essentially flat and triangular horizontal support surface bounded by a first edge, a second edge, and a third edge, wherein the first edge and the second edge form an essentially right angle;

a vertical presentation surface disposed at an essentially right angle depending downward from the third edge;

a horizontal support lip disposed along a bottom edge of the vertical presentation surface;

a first attachment tab protruding a first distance from the first edge and extending at least two-thirds a length of the first edge; and a second attachment tab protruding a second distance from the second edge and extending at least two-thirds a length of the second edge;

wherein the first tab protrusion distance and the second tab protrusion distance are configured to be received into a slot formed into a wall surface finishing material without penetrating beyond the wall surface finishing material thereby avoiding penetrating a waterproof membrane or a wall board;

wherein the first tab, the second tab and the horizontal supportive surface are essentially coplanar; and wherein the horizontal support surface and vertical presentation surface are configured to receive a feature finishing material.

2. The device as set forth in claim 1 wherein the feature finishing material comprises tile.

3. The device as set forth in claim 1 wherein the feature finishing material comprises cultured stone.

4. The device as set forth in claim 1 wherein the feature finishing material comprises natural stone.

5. The device as set forth in claim 1 wherein the feature finishing material comprises manmade solid surface material.

6. The device as set forth in claim 1 wherein the wall finishing material comprises tile.

7. The device as set forth in claim 1 wherein the wall finishing material comprises cultured stone.

8. The device as set forth in claim 1 wherein the wall finishing material comprises natural stone.

9. The device as set forth in claim 1 wherein the wall finishing material comprises manmade solid surface material.

10. The device as set forth in claim 1 comprising aluminum sheet metal.

11. The device as set forth in claim 1 comprising plastic.

12. The device as set forth in claim 1 further comprising a transverse support member provided beneath the horizontal support surface to reduce flexing of the support surface and to increase weight bearing capacity.

13. The device as set forth in claim 1 further configured to form a corner shelf.

14. The device as set forth in claim 1 further configured to form a corner seat.

15. The device as set forth in claim 1 further configured to form a corner step.

16. The device as set forth in claim 15 further one or more additional corner steps to form a multi-step set.

17. The device as set forth in claim 16 wherein the plurality of corner steps are configured in sequentially larger sizes to provide a multi-step set with a predetermined rake angle.

18. The device as set forth in claim 1 wherein the vertical presentation surface is about 16 inches in width.

19. A method of manufacture of a structurally supportive device for constructing a weight-bearing horizontal feature in a wet area of a building, the method comprising:

forming an essentially flat and triangular horizontal support surface bounded by a first edge, a second edge, and a third edge, wherein the first edge and the second edge form an essentially right angle;

disposing a vertical presentation surface at an essentially right angle depending downward from the third edge;

forming a horizontal support lip disposed along a bottom edge of the vertical presentation surface;

providing a first attachment tab protruding a first distance from the first edge and extending at least two-thirds a length of the first edge; and providing a second attachment tab protruding a second distance from the second edge and extending at least two-thirds a length of the second edge;

wherein the first tab protrusion distance and the second tab protrusion distance are configured to be received into a slot formed into a wall surface finishing material without penetrating beyond the wall surface finishing material thereby avoiding penetrating a waterproof membrane or a wall board;

wherein the first tab, the second tab and the horizontal supportive surface are essentially coplanar; and wherein the horizontal support surface and vertical presentation surface are configured to receive a feature finishing material.

20. A structurally supportive device for constructing a weight-bearing horizontal feature in a wet area of a building comprising:

an essentially flat and triangular horizontal support surface bounded by a first edge, a second edge, and a third edge, wherein the first edge and the second edge form essentially right angle;

a vertical presentation surface disposed at an essentially right angle depending downward from the third edge;

a horizontal support lip disposed along a bottom edge of the vertical presentation surface:

a first attachment tab protruding a first distance from the first edge and extending at least two-thirds a length of the first edge; and a second attachment tab protruding a second distance from the second edge and extending at least two-thirds a length of the second edge;

wherein the first tab protrusion distance and the second tab protrusion distance are configured to be received into a slot formed into a wall surface finishing material without penetrating beyond the wall surface finishing material thereby avoiding penetrating a waterproof membrane or a wall board;

wherein the structurally supportive device is configured to form a corner step with the structurally supportive device having one or more additional corner steps to form a multi-step set with the plurality of corner steps configured in sequentially larger sizes to provide a multi-step set with a predetermined rake angle; and wherein the horizontal support surface and vertical presentation surface are configured to receive a feature finishing material.

* * * * *